US006145364A

United States Patent [19]

Tippins et al.

[11] Patent Number: 6,145,364

[45] **Date of Patent: *Nov. 14, 2000**

[54] METHOD AND APPARATUS FOR ROLLING STRIP OR PLATE

[75] Inventors: William H. Tippins; George W. Tippins; Ronald D. Gretz, all of Pittsburgh, Pa.

[73] Assignee: Tippins Incorporated, Pittsburgh, Pa.

[ * ] Notice: This patent is subject to a terminal disclaimer.

[21] Appl. No.: 09/341,623

[22] PCT Filed: Jan. 15, 1998

[86] PCT No.: PCT/US98/00734

§ 371 Date: Sep. 10, 1999

§ 102(e) Date: Sep. 10, 1999

[87] PCT Pub. No.: WO98/31482

PCT Pub. Date: Jul. 23, 1998

[51] Int. Cl.[7] ..... B21B 27/06; B21B 1/00

[52] U.S. Cl. ..... 72/201; 72/203; 72/365.2

[58] Field of Search ..... 72/200, 201, 202, 72/203, 204, 234, 235, 365.2, 366.2

[56] References Cited

U.S. PATENT DOCUMENTS

| | | | |
|---|---|---|---|
| 4,420,960 | 12/1983 | Grasshoff | 72/202 |
| 4,534,198 | 8/1985 | Noéet al. | 72/201 |
| 5,284,042 | 2/1994 | Beneetti | 72/204 |
| 5,435,164 | 7/1995 | Di Giusto et al. | 72/202 |
| 5,727,412 | 3/1998 | Tippins et al. | 72/203 |

*Primary Examiner*—Rodney A. Butler
*Attorney, Agent, or Firm*—Webb Ziesenheim Logsdon Orkin & Hanson, P.C.

[57] ABSTRACT

Large slabs are processed into memory free strip or plate. The large slabs are rolled into strip or plate on a rolling mill with a finishing temperature of above 1340° F. The strip or plate is cooled inline to a temperature in the range of 900°–650° F. with the strip or plate laid out on a flat cooling conveyor. The speed of the strip or plate is slowed to speeds typical of cut-to-length lines. The strip or plate is side trimmed and cut to length and the strip or plate is subsequently stacked.

10 Claims, 4 Drawing Sheets

METHOD AND APPARATUS FOR ROLLING STRIP OR PLATE

BACKGROUND OF THE INVENTION

The economics of steel strip and plate production favor the processing of large slabs, sometimes referred to as "jumbo" and "junior jumbo" slabs. These slabs are too large to be used to roll a single strip or plate. Typically, jumbo slabs weigh approximately 30 tons, junior jumbo slabs from 10 to 15 tons and normal or pattern slabs 1 to 2 tons. Pattern slabs are just large enough to produce a single strip or plate following end cropping.

When the product of a pattern slab emerges from the hot rolling mill, it is typically transferred perpendicular to the rolling direction onto a parallel cooling bed where it remains flat until cooled below the brittle temperature range (about 500° F. to 300° F.). Because it is never coiled, the strip or plate cannot suffer the disadvantage of coil memory or uncoiling flaws, such as coil break. On the other hand, the economics of rolling pattern slabs and cooling on a parallel cooling bed are limited. For example, the hot rolling mill must be set up over and over again for each different pattern slab introduced to the mill. The ends of every strip or plate must be cropped reducing the yield from many pattern slabs versus the yield from one or several jumbo or junior jumbo slabs. The capacity of the parallel cooling bed varies depending upon the width of the strip or plate transferred to it due to the uniform placement of the "dogs" that pull the plates over the bed. Unless the strip or plate width is almost an exact multiple of the spacing between the "dogs", the cooling bed is less than 100% covered reducing its throughput.

The current practice for rolling jumbo slabs and junior jumbo slabs is to hot coil the strip or plate and then to place the coils in storage for at least about three days and sometimes weeks before uncoiling, leveling and passing the strip or plate to a cut-to-length line. The three-day cooling period is required because if the coil is unwound while still in the temperature range of 650° F. to 100° F., the strip or plate will suffer from what is known as coil breaks. Coil breaks are visible and undesired metallurgical deformations of the strip that cannot be corrected by further processing.

While the three-day cooling period alleviates or overcomes the problem of coil breaks, it results in another drawback known as coil memory. Once a coil is allowed to cool below 650° F., the strip or plate "remembers" the curved shape of the coil even after leveling and cutting. Leveling (processing through a series of small rolls positioned alternately above and below the strip or plate to alternately pull each surface beyond the yield point) does so in part by balancing the residual stress in the plate around a neutral axis. This results in trapped stresses. On subsequent cutting of the plate or strip, these stresses can produce a shape defect. (This effect is directly related to strip or plate thickness for a given coil diameter.) Also, cooling the coils for from three days to several weeks creates a process inventory that ties up valuable working capital.

The coil memory problem can be avoided by never forming and cooling as a finished coil. A process coiling with flat-pass finishing has been proposed for product rolled from large slabs but not without using a parallel cooling bed and cutting the strip or plate as it emerges from the finishing pass into a length that the width of the cooling table can accommodate.

It is an advantage, according to this invention, to roll jumbo or junior jumbo slabs to strip or plate with in-line cooling (without using a parallel cooling bed) and without experiencing the drawbacks of coil break and coil memory.

SUMMARY OF THE INVENTION

Briefly, according to this invention, there is provided a method of processing large slabs into memory free strip or plate. The method comprises first rolling a large slab to strip or plate on a hot mill with a finishing temperature above 1350° F., that is, above the eutectoid temperature of 727° C. (1340° F.). The next step comprises in-line cooling of the strip or plate to a temperature in the range of 900° F. to 650° F. with the slab laid out on a flat cooling conveyor. Next, the strip or plate is side trimmed and/or cut to length at temperatures above 500° F. Following cooling to a temperature below about 300° F., the strip or plate is piled.

According to one embodiment of this invention, immediately following hot rolling, the strip or plate is coiled at temperatures above 1350° F. at the finishing speed and then uncoiled at a speed to facilitate side trimming and cutting to length. Preferably, cooling after uncoiling takes place in a short water cooling section.

According to yet another embodiment of this invention, a runout table is provided which is long enough to receive the entire strip or plate rolled from a large slab so that after the tail of the strip or plate has emerged from the rolling mill, it may be slowed to speeds at which side trimming and cutting to length are practical.

DESCRIPTION OF THE PREFERRED EMBODIMENTS

Figure 1:
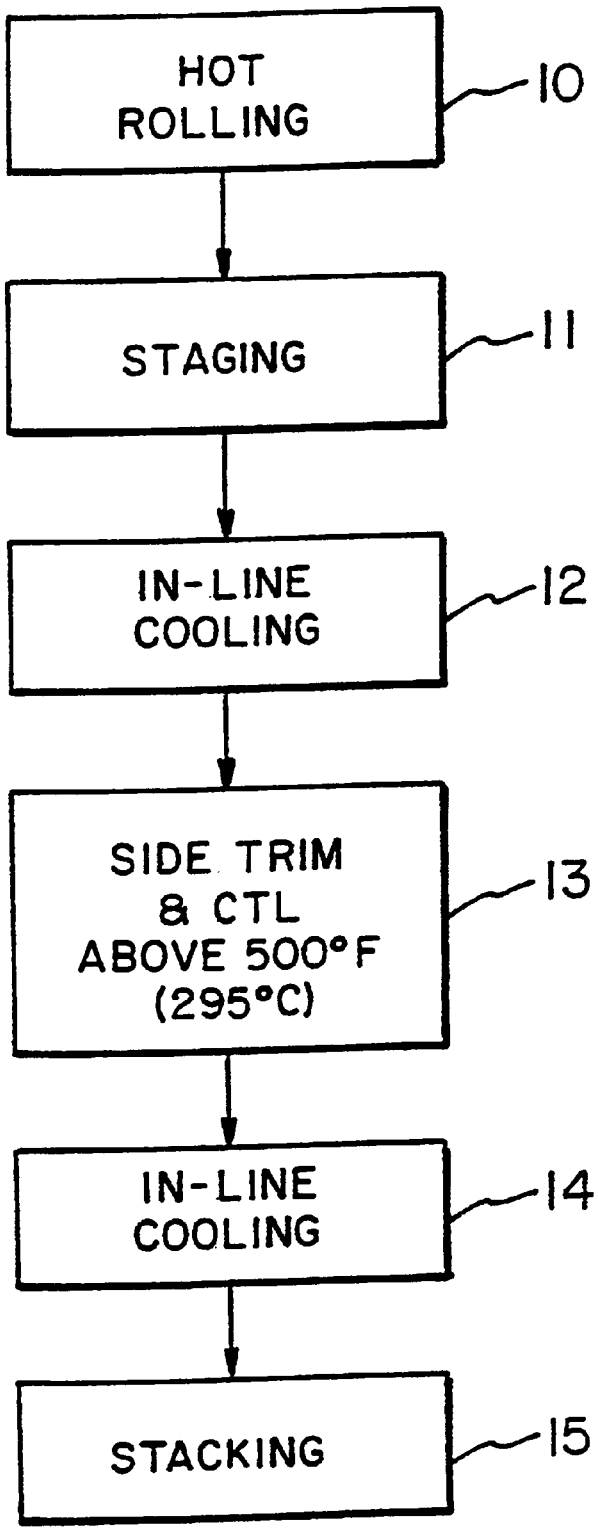
FIG. 1 is a flow diagram illustrating the general process for processing large slabs of strip or plate according to this invention.

Referring to FIG. 1, the general process, according to this invention, is illustrated. Following hot rolling of strip or plate 10 from large slabs, for example, in a Steckle Mill with hot coilers upstream and downstream from the mill, the strip or plate emerges from the last pass at finishing speeds, say, 1,500 feet per minute. Most of the downstream processing is more easily carried out at slower speeds, say, 500 feet per minute. Thus, a staging step 11, that is, slowing the rolling mill product after the entire strip or plate has emerged from the mill, takes place either before or after a first in-line cooling step 12. The first in-line cooling step has for its purpose to reduce the temperature of the strip or plate to near 650° F. The strip at this temperature is not yet to the brittle range (500° F. to 300° F.). The strip or plate is then side trimmed and/or cut to length at temperatures above the brittle range. A second in-line cooling step 14 reduces the temperature of the strip or plate to below 300° F. and the product is stacked at 15.

Figure 2:
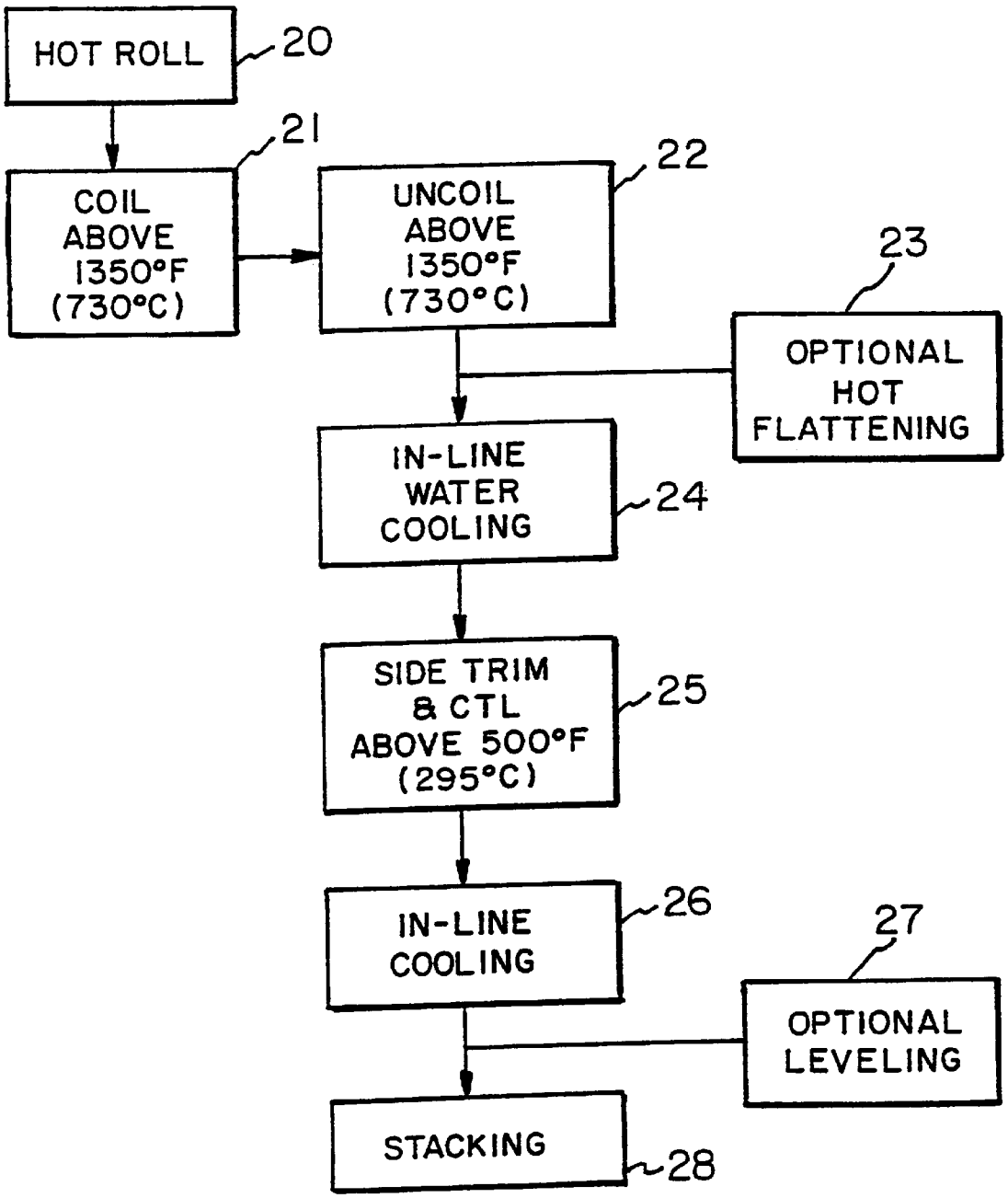
FIG. 2 is a flow diagram illustrating a method embodiment according to this invention wherein the strip or plate emerging from the hot rolling mill is coiled above 1350° F. and uncoiled above 1350° F.

According to one method embodiment as described with reference to FIG. 2, large slabs are first hot rolled into strip or plate during a hot rolling step 20. This is followed by a step for coiling 21 at temperatures above the austenite to ferrite transition range (about 1340° F. (727° C.)). In the next step, the coils are transferred to a cut-to-length line and uncoiled at 22 while still above the transition temperature. The coiling and uncoiling provide for staging since there typically is a period of about 5 minutes (that is, the time it takes to roll a slab in a sequence of passes to a finish coil) between coil transfers. The uncoiling can take place at about one-tenth the speed of coiling.

The uncoiled strip or plate may then be passed to an optional hot flattening step 23 before it is passed along to a second in-line cooling step 24. This cooling step may, for example, be a laminar flow water cooling bank of known construction. The number of headers supplying cooling water needed for cooling are much reduced compared to laminar flow cooling banks used for cooling strip or plate as it emerges from the rolling mill due to the large difference in speeds of the strip or plate as it moves through the cooling banks. Ideally, the in-line cooling reduces the temperature of the strip or plate to near but not below 500° F. The next step 25 is side trimming or cutting to length (CTL) while the strip or plate is still above the brittle temperature range. A second in-line cooling step 26 follows reducing the temperature of the strip or plate below 300° F. An optional precision leveling step 27 may precede a step 28 for stacking the strip or plate.

Figure 3:
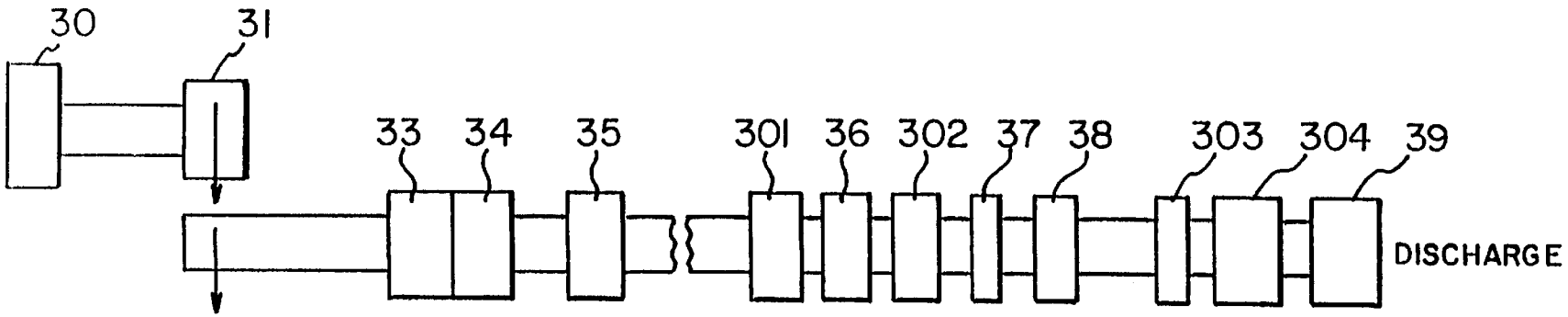
FIG. 3 is a schematic layout of a rolling mill and cut-to-length line useful for practicing the method embodiment described in FIG. 2.

Referring now to FIG. 3, there is illustrated a cut-to-length line for the practice of the method embodiment described with reference to FIG. 2. The strip or plate enters coiler 31 from the hot strip mill 30 and runout table 32. A laminar flow cooler may be positioned on the runout table 32 to cool the surface just sufficiently to control scale formation. The coil is then transferred to uncoiler 33 and may optionally uncoil into hot flattener 34. The strip or plate then proceeds to a first water cooler 35, for example, a laminar flow water cooler. A runout table following the first water cooler conveys the strip or plate to a side trimmer 36 and/or cut-to-length shear 37. The strip or plate is then conveyed to the stacker 39. Optionally, a skin pass mill 301 may be positioned after the first water cooler 35. Optionally, a recoiler may be positioned after the side trimmer, although if the recoiler is used, it would be a departure from the methods according to this invention. Typically, a shear gauge 303 is placed downstream of the second water cooler 38. Optionally, a precision leveler 304 is located just before the stacker 39.

This invention is based on the concept of charging a hot coil from the hot strip mill or the Tippins patented coil plate process or coiled directly into a newly-designed, cut-to-length line. This coil transfer can occur automatically through a coil transfer device or by manually operated mobile transfer equipment.

This invention not only contemplates a new type of cut-to-length line, but also new operating practices in both the hot rolling mill and cut-to-length line. As the hot strip or plate exits the roll bite of the last finishing pass on the hot rolling mill, the material surface is reduced in temperature or chilled by water cooling to stop oxide scale formation. However, the material will be kept above 1340° F. (the eutectoid decomposition temperature) to retain the as-rolled austenitic phase prior to hot mill finish coiling. The finished hot coil must then be transferred to the cut-to-length line and the entire coil must be uncoiled in a controlled sequence to control the rate of temperature change below 1340° F., the point at which the high temperature phase begins forming the low temperature phase and the final material properties. If the transfer is not accomplished in the correct time-temperature window, the coil must be diverted to a coil cooling area for conventional processing. The cut-to-length line might also be designed to accept cold coils produced under the conventional practice.

The above-described process sequence allows for net elongation of the strip at the optional skin pass rolling step, thereby creating the opportunity to bring all parallel "fibers" of the metal to the same length or state of strain. The process critical part of the invention is to take a transverse section of the strip through a well-controlled, time-temperature (or cooling rate) sequence in a precisely controlled fashion to create transformed metal with consistent properties. This is achieved by carefully controlling the uncoiling speed and water flow in the laminar flow cooler for any given strip or plate thickness. The cut-to-length line may be fully automated and designed to automatically cool the strip at- the appropriate rate to the appropriate temperature to ensure accurate control of the material's metallurgical properties.

A summary of the described typical cooling practice for the new invention is described below.

| PROCESS | DESCRIPTION | TEMPERATURE* |
|---|---|---|
| Rolling Mill | Last pass finish temperature | 1450° F.–1750° F. (typical) |
| Laminar Flow/Coiler | Surface chill to stop scale | 1350° F.–1450° F. (surface) |
| Water Cool | Phase transformation | 1350° F.–900° F. |
| Side Trim/Shear | Warm range | 900° F.–500° F. |
| Water Cool | Brittle range | 500° F.–300° F. |
| Precision Level | Finish | 300° F.–100° F. |

*mean body temperature, except where noted.

Figure 4:
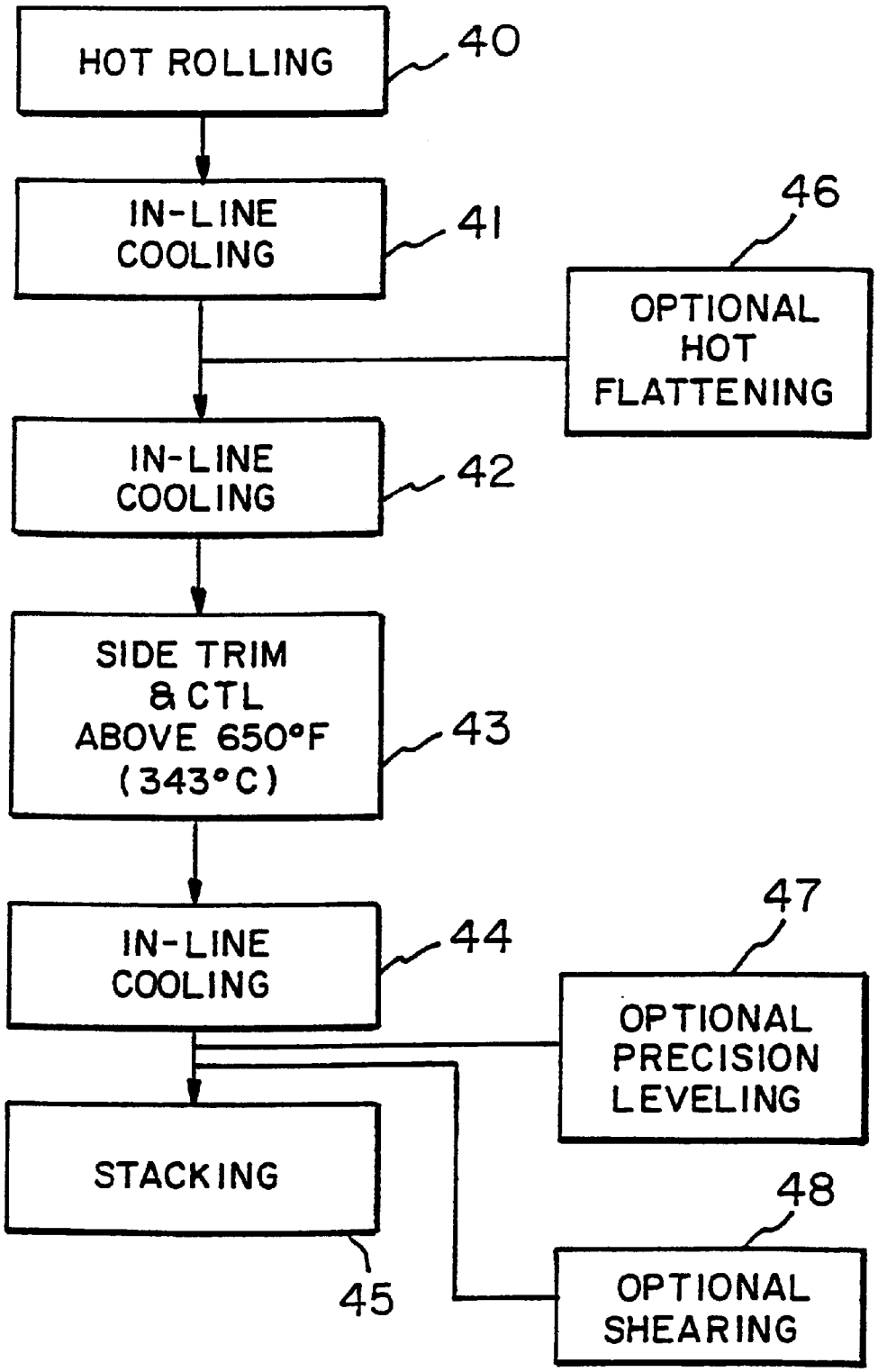
FIG. 4 is a flow diagram illustrating a method embodiment according to this invention wherein in-line cooling takes place upon a very long rollout table or cooling conveyor.

Referring to FIG. 4, another method embodiment is illustrated. This method comprises a hot rolling step 40 followed by an in-line cooling step 41 and the second in-line cooling step 42. In some embodiments, the first and second in-line cooling steps can be combined as one. An optional hot flattening step 46 may take place between the first and second in-line cooling steps. After the strip has been cooled to near 650° F., it is side trimmed and/or cut to length in a step 43. A final in-line water cooling step 44 may precede a step 45 for stacking the strip or plate. Also, an optional precision leveling step 47 may precede the stacking step. Finally, if the side trim step does not include a cut-to-length step, a shearing step 48 is required just preceding the stacking step.

Figure 5:
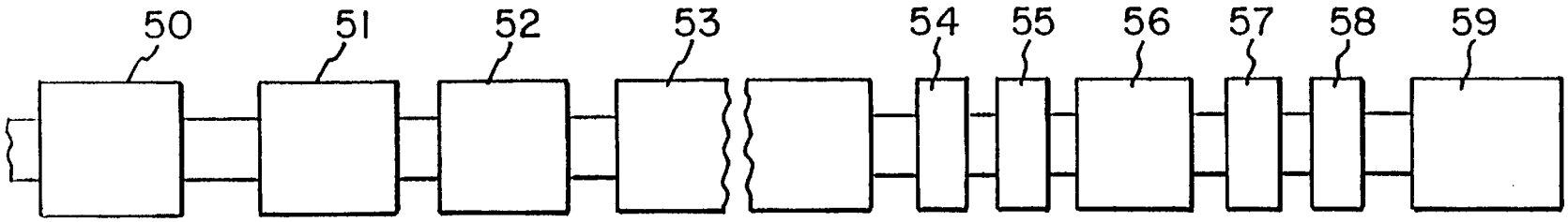
FIG. 5 is a schematic layout for a rolling mill and cut-to-length line useful for practicing the method embodiment described with reference to FIG. 4.

Referring now to FIG. 5, there is illustrated an in-line cooling and cut-to-length line for practice of the method embodiment described with reference to FIG. 4. Rolling mill 50 delivers the strip or plate to a laminar flow cooler 51 and then to an optional hot leveler 52. The strip or plate is then passed to a very long in-line air cooling conveyor 53. At the end of the air cooling conveyor, side trimmer 54 and shear 55 are arranged to side trim and cut to length the strip or plate. A cooling tank 56 further cools the side trimmed and sheared plate prior to passing through an optional precision leveler 57. A shear 58 is positioned to cut the strip or plate to length if it has not been cut to length with shear 55 and finally the strip or plate is fed to stacker 59.

With the apparatus described with reference to FIG. 5, the plate is rolled at the rougher and finishing mill utilizing junior jumbo or jumbo slabs. The slabs are rolled straight away or cross rolled to width as required. Typically, the finished thickness will range from 3/16 inch to 1 inch. As the product is rolled from the finishing mill on the last pass, the plate is run through the laminar flow cooling system which cools the workpiece to a targeted temperature to set the physical properties, cools the surface of the plate to stop the growth of scale and provides additional cooling for shedding heat energy in the workpiece. The targeted temperatures of the plate emerging from the finishing mill and going onto the cooling bed are set forth in the following table for some typical grades and thicknesses.

FINISHING AND TARGETED TEMPERATURES

| Grade | Min. Gauge | Max. Gauge | Min. Width | Max. Width | Mill Finish Temp. | Cooling Bed Entry Targeted Temp. |
|---|---|---|---|---|---|---|
| A36 1012 | 0.1670 | 0.1680 | 22.000 | 104.000 | 1575 | 1075 |
| A635 1012 | 0.1800 | 0.7500 | 22.000 | 104.000 | 1600 | 1175 |
| X-42 | 0.2500 | 0.4050 | 72.000 | 96.000 | 1575 | 1200 |
| A572 42 | 0.1800 | 0.7500 | 22.000 | 104.000 | 1575 | 1150 |
| X-52 | 0.2500 | 0.5000 | 72.000 | 96.000 | 1575 | 1175 |
| X-60 | 0.2500 | 0.5000 | 72.000 | 96.000 | 1425 | 950 |
| X-65 | 0.2500 | 0.3750 | 72.000 | 96.000 | 1425 | 1075 |
| X-70 | 0.2400 | 0.5250 | 72.000 | 96.000 | 1425 | 1075 |

After emerging from the laminar flow cooling bed, the workpiece may travel through an existing leveler (optional) onto a disc-type conveyor which comprises a linear cooling conveyor to move the workpiece slowly to the cut-to-length line.

When the workpiece arrives at the cut-to-length line, the temperature of the plate is approximately 650° F. which is an acceptable temperature for side trimming, leveling and cutting to length. An optional water cooling trough similar in design to a push-pickling line may be used to submerge the plate to remove heat therefrom. Upon exiting the water cooling trough, the workpiece proceeds to an inner blowoff (not shown), optional precision levelers and an optional cut-on-the-fly shear. Daughter plates cut to a length up to, say, 72 feet, travel to a stack which may consist of an inverted magnetic roller table with an end stop and are dropped onto a stack formed under the table. The stacks are then removed onto a side transfer mechanism for access to overhead cranes or mobile carriers. The time in minutes to reduce the strip or plate from 1200° F. to 625° F. depending upon the thickness of the strip or plate is set forth in the following table.

| Thickness (inch) | Time (minutes) |
|---|---|
| .0800 | 2.215 |
| .100 | 2.771 |
| .125 | 3.46 |
| .135 | 3.74 |
| .187 | 5.19 |
| .250 | 6.92 |
| .375 | 10.38 |

The required linear cooling conveyor length is the product of the number of spaces on the cooling conveyor and the plate length which results in a relationship that is independent on gauge given by L (m)=1.1, P where P is the process throughput rate in metric tons per hour as shown in the following chart.

| Throughput Rate | | Linear Cooling Bed Length |
|---|---|---|
| Metric Tons/Hour | Cycle Time (min.) | Feet |
| 100 | 7.25 | 360 |
| 150 | 4.84 | 541 |
| 200 | 3.62 | 722 |

As can be seen, the methods of hot rolling as described herein and the in-line cooling and cut-to-length lines as described herein enable the processing of very large slabs while avoiding the use of parallel cooling beds and overcome the problems associated with coiling and uncoiling at low temperatures. A key feature of this process is the recognition that each unit process, such as hot rolling or coiling, has a definite time period. A pacing time for the finishing mill can be chosen without a significant loss of production because the unit operations after hot rolling provide a retention time consistent with the overall process pacing and proper product cooling which is chosen to achieve the desired properties.

Having thus described our invention with the detail and particularity required by the Patent Laws, what is desired protected by Letters Patent is set forth in the following claims.

What is claimed is:

1. A method of processing large slabs into memory free strip or plate comprising the steps of:

a) rolling the large slabs into strip or plate on a rolling mill with a finishing temperature above 1340° F.;

b) coiling the strip or plate at a temperature above 1340° F.;

c) transferring the coiled strip or plate to an in-line cooling and cut-to-length line and uncoiling at temperatures above 1340° F. at speeds below 150 feet per minute;

d) in-line cooling the strip or plate to a temperature below 900° F. with the strip or plate laid out on a flat cooling conveyor;

e) side trimming and/or cutting the strip or plate to lengths; and f) stacking the strip or plate.

2. The method according to claim 1 wherein the strip or plate is cooled prior to coiling at a temperature above 1340° F. to control scale formation.

3. The method according to claim 1 wherein the strip or plate is uncoiled into a hot flattener and flattened prior to in-line cooling.

4. The method according to claim 1 wherein after side trimming and/or cutting the strip or plate to lengths the strip or plate is cooled to a temperature below 300° F. and the strip or plate is passed through a precision leveler.

5. The method according to claim 1 wherein part of the in-line cooling takes place in a laminar flow water cooling bed.

6. The method according to claim 1 wherein said side trimming and/or cutting the strip or plate to length is at temperatures above 500° F.

7. A method of processing large slabs into memory free strip or plate comprising the steps of:

a) rolling the large slabs into strip or plate on a rolling mill with a finishing temperature above 1340° F.;

b) in-line cooling the strip or plate to a temperature below 900° F. with the strip or plate laid out on a flat cooling conveyor;

c) slowing the speed of the strip or plate to speeds typical of cut-to-length lines;

d) side trimming and/or cutting the strip or plate to lengths; and e) stacking the strip or plate.

8. The method according to claim 1 wherein said side trimming and/or cutting the strip or plate to length is at temperatures above 500° F.

9. A method of processing large slabs into memory free strip or plate comprising the steps of:

a) rolling the large slabs into strip or plate on a rolling mill with a finishing temperature above 1340° F.;

b) slowing the speed of the strip or plate to speeds typical of cut-to-length lines on a rollout table long enough to accept the entire strip or plate without being cut;

c) in-line cooling the strip or plate to a temperature below 900° F. with the strip or plate laid out on a flat cooling conveyor;

d) side trimming and/or cutting the strip or plate to lengths; and e) stacking the strip or plate.

10. The method according to claim 9 wherein said slowed speed of the strip or plate which is typical of cut-to-length lines is below 150 feet per minute, said in-line cooling is to a temperature in the range of 900° F. to 650° F., said side trimming and/or cutting the strip or plate to lengths is at temperatures above 500° F., and further including in-line cooling the strip or plate to a temperature below 300° F. prior to said stacking the strip or plate.

* * * * *

UNITED STATES PATENT AND TRADEMARK OFFICE

CERTIFICATE OF CORRECTION

PATENT NO. : 6,145,364
DATED : November 14, 2000
INVENTOR(S) : William H. Tippins et al.

It is certified that error appears in the above-identified patent and that said Letters Patent is hereby corrected as shown below:

Title Page,
Item [75] Inventors, should read:
--William H. Tippins, Pittsburgh; George W. Tippins, Pittsburgh; Ronald D. Gretz, Brackenridge, all of Pa.--

Title Page Insert:
--Related U.S. Application Data
Item [60 ] Continuation of application No. 08/784,970, filed Jan. 16, 1997, now U.S. Pat. 5,727,412 granted Mar. 17, 1998--.

Title Page,
Item [56] References Cited, refer to Pat. No. 4,534,198: "Noéet al. should read --Noé et al.

Column 1,
After the Title, insert:
--CROSS REFERENCE TO RELATED APPLICATION
This application is the national stage of International Application No. PCT/US98/00734, filed Jan. 26, 1997, now U.S. Pat. 5,727,412, granted Mar. 17, 1998.--.

Column 4,
Line 22, "at- the" should read --at the--.

UNITED STATES PATENT AND TRADEMARK OFFICE

CERTIFICATE OF CORRECTION

PATENT NO. : 6,145,364
DATED : November 14, 2000
INVENTOR(S) : William H. Tippins et al It is certified that error appears in the above-identified patent and that said Letters Patent is hereby corrected as shown below:

Column 5,
In Table entitled "Finishing and Targeted Temperatures", second column, first figure: "0.1670" should read --0.1870--.
In Table entitled "Finishing and Targeted Temperatures", third column, first figure: "0.1680" should read --0.1880--.

Column 7,
Line 6, Claim 8, "according to claim 1" should read --according to claim 7--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*